US006672850B2

(12) United States Patent
Palazzolo et al.

(10) Patent No.: US 6,672,850 B2
(45) Date of Patent: Jan. 6, 2004

(54) TORQUE CONTROL OIL PUMP WITH LOW PARASITIC LOSS AND RAPID PRESSURE TRANSIENT RESPONSE

(75) Inventors: Joseph Palazzolo, Livonia, MI (US); Perry E. Phelan, Harsens Island, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/037,022

(22) Filed: Dec. 21, 2001

(65) Prior Publication Data

US 2003/0118454 A1 Jun. 26, 2003

(51) Int. Cl.[7] ..... F01G 21/16; F03G 2/00; F03G 4/00; F04G 15/04; F04G 2/00

(52) U.S. Cl. ..... 418/21; 418/170; 418/127; 417/53

(58) Field of Search ..... 418/21, 170, 127; 417/53

(56) References Cited

U.S. PATENT DOCUMENTS

| | | | | |
|---|---|---|---|---|
| 1,307,602 A | | 6/1919 | Schirmer | |
| 1,672,257 A | | 6/1928 | Heitz | |
| 1,768,818 A | * | 7/1930 | Bock | 418/170 |
| 1,773,211 A | * | 8/1930 | Wilsey | 418/9 |
| 2,433,360 A | * | 12/1947 | Haight | 418/79 |
| 2,671,410 A | * | 3/1954 | Wahlmark | 418/39 |
| 2,893,323 A | * | 7/1959 | Enemark et al. | 418/39 |
| 2,948,228 A | | 8/1960 | Ahlen | 103/120 |
| 3,443,522 A | | 5/1969 | Schindler | 103/126 |
| 3,586,465 A | * | 6/1971 | Eltze | 418/126 |
| 3,597,129 A | | 8/1971 | Crowther | 418/126 |
| 3,679,335 A | * | 7/1972 | Zippel et al. | 418/170 |
| 3,785,756 A | * | 1/1974 | Langenderfer | 418/170 |
| 3,810,721 A | | 5/1974 | Eyer | 417/440 |
| 3,876,349 A | | 4/1975 | Svensson | 418/169 |
| 3,907,470 A | * | 9/1975 | Harle et al. | 418/170 |
| 4,084,926 A | | 4/1978 | Gram | 418/19 |
| 4,097,204 A | | 6/1978 | Palmer | 418/19 |
| 4,132,515 A | | 1/1979 | Kruger | 418/71 |
| 4,391,580 A | | 7/1983 | Hunsberger et al. | 417/440 |
| 5,163,826 A | | 11/1992 | Cozens | 418/170 |
| 5,266,011 A | | 11/1993 | Son | 47/297.5 |
| 6,089,841 A | | 7/2000 | Meernik et al. | 418/170 |
| 6,314,642 B1 | * | 11/2001 | Thompson et al. | 29/888.023 |
| 6,419,471 B1 | * | 7/2002 | Arbogast et al. | 418/170 |
| 6,425,747 B2 | * | 7/2002 | Buchmuller et al. | 418/126 |

OTHER PUBLICATIONS

Copy of Great Britain Search Report under Section 17 for corresponding patent application No. GB 0226664.1, dated May 28, 2003, 1 page.

* cited by examiner

*Primary Examiner*—Cheryl J. Tyler
*Assistant Examiner*—William H. Rodriguez
(74) *Attorney, Agent, or Firm*—Brinks Hofer Gilson & Lione

(57) ABSTRACT

A torque control crescent oil pump, having low parasitic loss and rapid pressure transient response, and a method for controlling oil flow within the pump, are provided. In one embodiment, the crescent oil pump comprises a housing, toothed annular gears cooperatively rotating about preferably offset first and second axes, and a crescent body. The crescent body is adapted to move from a first position to a second position. In the first position, the crescent body is adapted to form a seal between the annular gears. In the second position, the crescent body is positioned so that it does not form a seal between the annular gears. In another embodiment, an actuating device moves the crescent body from the first position to the second position.

25 Claims, 3 Drawing Sheets

TORQUE CONTROL OIL PUMP WITH LOW PARASITIC LOSS AND RAPID PRESSURE TRANSIENT RESPONSE

BACKGROUND OF THE INVENTION

This invention relates generally to a torque control crescent oil pump, having low parasitic loss and rapid pressure transient response, and to a method for controlling oil flow within the pump.

Crescent oil pumps are widely used in automatic transmissions, engines, and other similar applications to control torque. A crescent oil pump typically comprises a sealed housing having an inlet port and a discharge port, a driving inner gear rotating within the housing along one axis, and a driven outer gear rotating within the housing along a second offset axis. External gear teeth on the driving gear mesh with internal gear teeth on the driven gear between the inlet and the discharge ports. In such manner, the discharge port is sealed from the inlet port in the direction of rotation of the driving and the driven gears. External and internal troughs on the driving and driven gears between the gear teeth define pump chambers, which transfer fluid from the inlet port to the outlet port as the gears rotate.

The teeth of the inner and outer gears separate from each other at the bottom band of the gears due to the offset axes. The bottom band of the gears is typically sealed using a stationary crescent shaped body machined into the housing between the external teeth of the inner gear and the internal teeth of the outer gear. The crescent shaped body has a pair of arc-shaped walls which closely fit around the inner and outer gears. The arc-shaped walls cooperate with the tips of the external teeth of the inner gear, and cooperate with the tips of the internal teeth of the outer gear to define fluid seals against leakage from the discharge port to the inlet port.

Crescent pump gear systems are often used in pumps with high-pressure applications. The sealing capability of the gears against the crescent is enhanced due to the number of teeth on both the inner and outer gears that seal across the crescent.

However, crescent oil pumps typically have high parasitic loss resulting from oil circulation at low pressure through restrictive hydraulic circuits. Parasitic loss results in poor fuel economy, and produces undesirable wheel torques. Two types of variable displacement pumps, piston and vane, are not restrictive, but are slow and have high control forces.

It is necessary to develop a torque control crescent oil pump, having low parasitic loss and rapid pressure transient response, to be more fuel efficient while being capable of rapidly delivering peak torque.

BRIEF SUMMARY OF THE INVENTION

It is in general an object of the invention to provide a torque control crescent oil pump, having low parasitic loss and rapid pressure transient response, and to provide a method for controlling oil flow within the pump.

In one aspect, this invention provides a crescent oil pump comprising a housing, an externally toothed annular gear capable of rotation about a first axis, and an internally toothed annular gear capable of rotation about a second axis. It further comprises a crescent body adapted to move from a first position to a second position. When in the first position, the crescent body is adapted to form at least one seal between a portion of the externally toothed annular gear and a portion of the internally toothed annular gear. When in the second position, the crescent body is positioned so that it does not form a seal between the portion of the externally toothed annular gear and the portion of the internally toothed annular gear.

In another aspect, this invention provides a crescent oil pump comprising a housing, an externally toothed annular gear capable of rotation about a first axis, and an internally toothed annular gear capable of rotation about a second axis. It further comprises an actuating device and a crescent body adapted to move from a first position to a second position by the actuating device.

In yet another aspect, this invention provides a method of controlling oil flow within a crescent oil pump. First, a crescent oil pump is provided comprising a housing, an externally toothed annular gear capable of rotation about a first axis, and an internally toothed annular gear capable of rotation about a second axis. The crescent oil pump further comprises an actuating device, and a crescent body adapted to move from a first position to a second position by the actuating device. The crescent body is then moved to the first position using the actuating device to restrict oil flow within the housing. Finally, the crescent body is moved to the second position using the actuating device to permit oil flow within the housing.

The present invention, together with further object and advantages, will be best understood by reference to the following detailed description taken in conjunction with the accompanying drawings.

DETAILED DESCRIPTION OF THE INVENTION

The workings of a crescent oil pump are well known in the art. For general background regarding crescent oil pumps, refer to U.S. Pat. No. 5,163,826, issued Nov. 17, 1992, and U.S. Pat. No. 6,089,841, issued Jul. 18, 2000.

Figure 1:
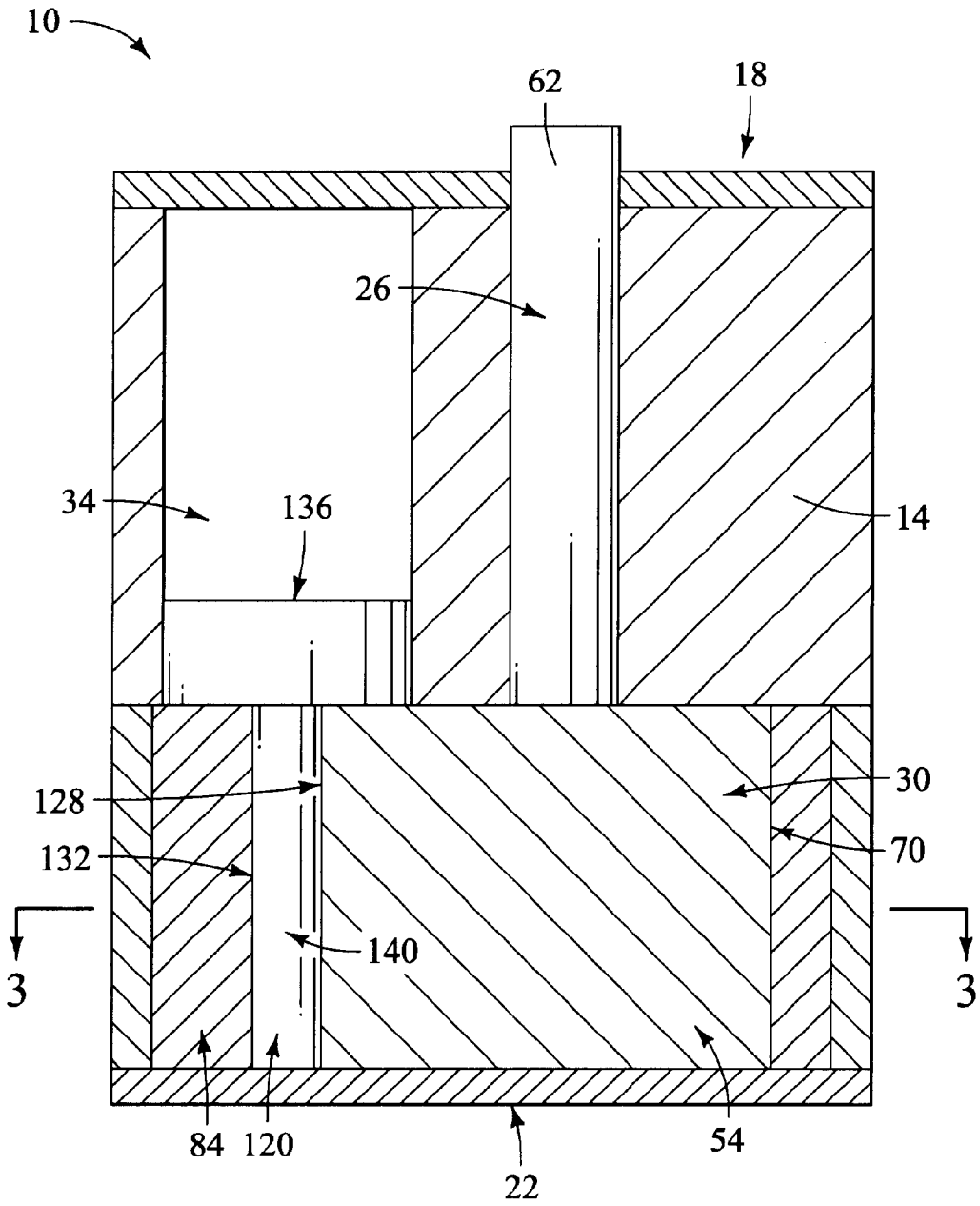
FIG. 1 is a front, sectional view of a crescent oil pump, with the crescent in a first position, in accordance with the invention.
Figure 2:
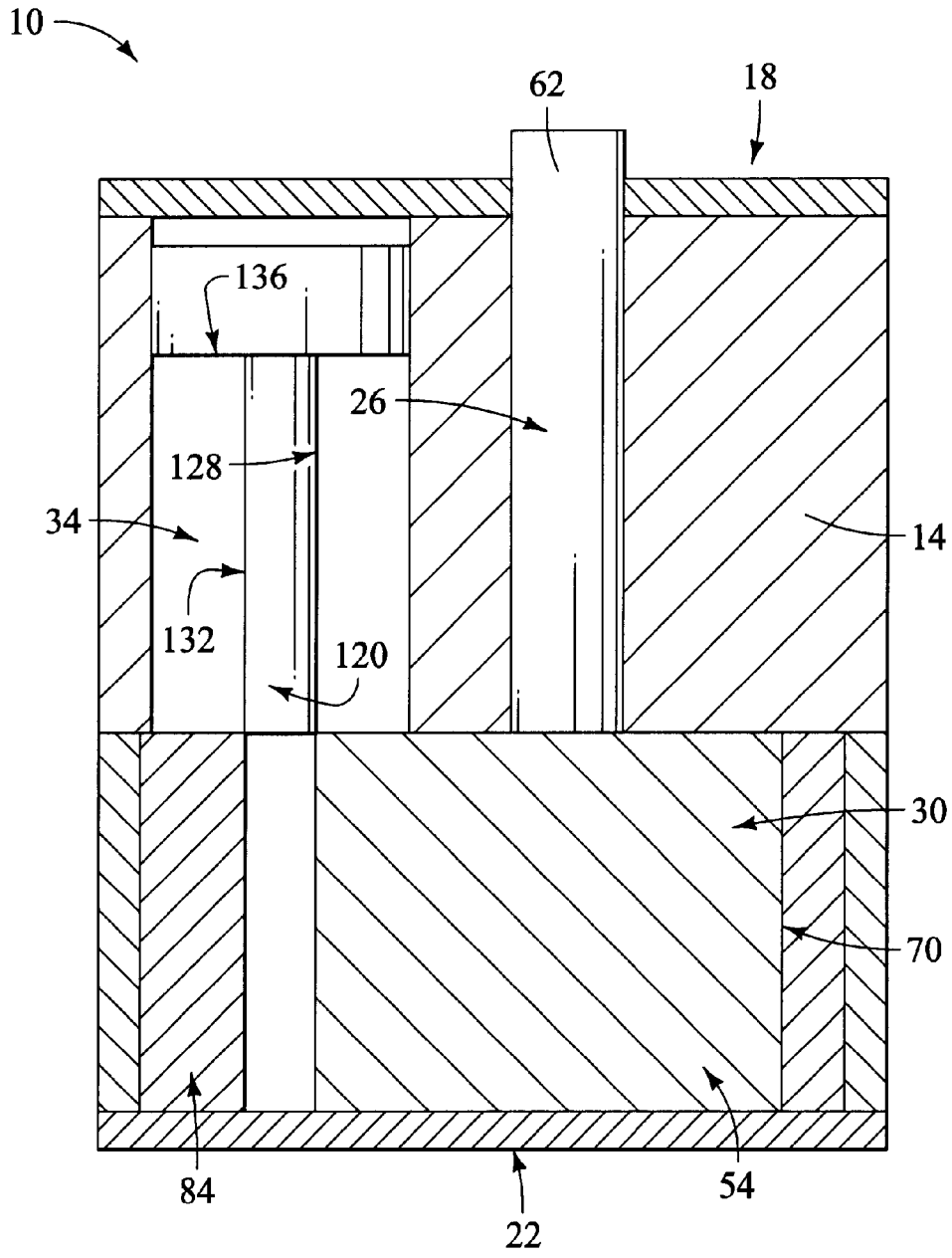
FIG. 2 is a front, sectional view of the crescent oil pump shown in FIG. 1, with the crescent in a second position, in accordance with the invention.
Figure 3:
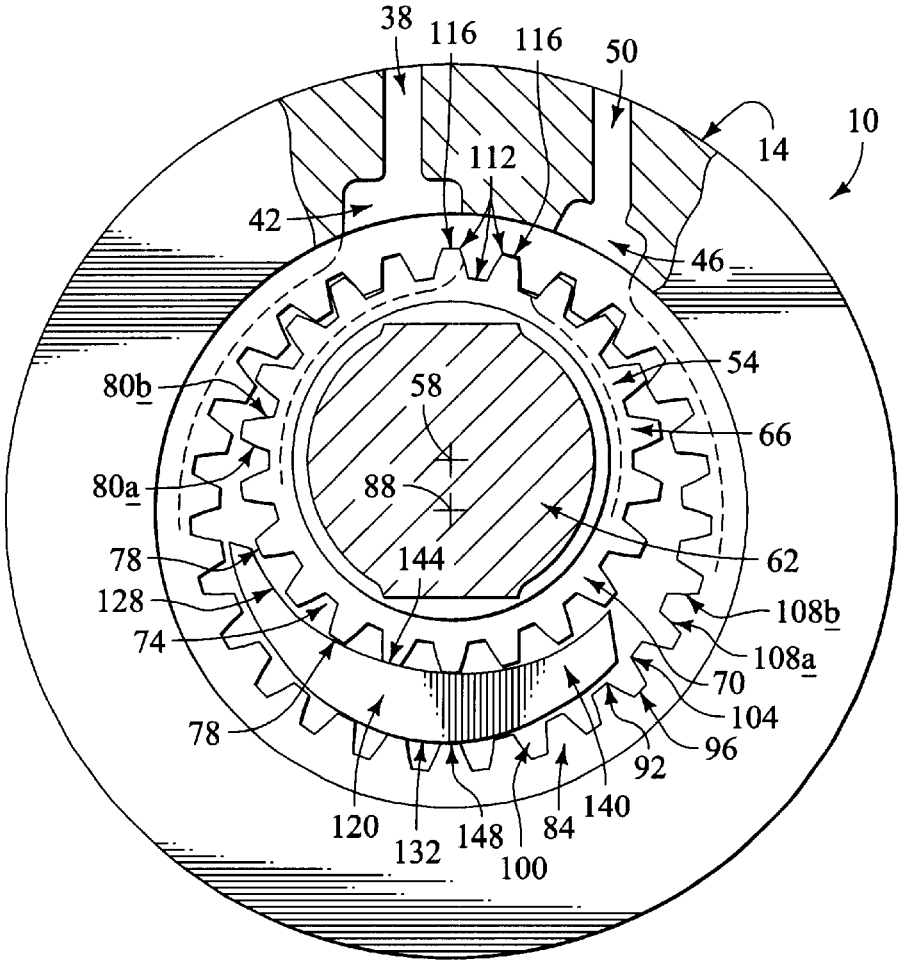
FIG. 3 is a cross-section taken along line 3—3 in FIG. 1.

FIGS. 1–3 show the crescent oil pump 10 of the invention. In particular, FIGS. 1–2 show the crescent oil pump 10 with the crescent shaped body 120 in down and up positions respectively. As shown, a crescent oil pump 10 of the invention includes a generally cylindrical housing 14. The housing 14 includes a top cover 18 and a bottom cover 22, which together seal the housing 14. The housing 14 defines a first bore 26, a second bore 30, and a third bore 34, within the housing 14. Preferably, the bores are cylindrical. The housing 14 further defines an inlet passage 38, an inlet port 42, a discharge port 46, and a discharge passage 50.

The inlet passage 38 is connected to a fluid reservoir, not shown, for allowing fluid into the housing 14 through the inlet port 42. The discharge passage 50 is connected to a fluid operated device, not shown, such as a fluid operated motor, for discharging fluid from the housing 14 through the discharge port 46.

An externally toothed annular gear 54, also referred to as the driving gear 54, is supported within the second bore 30 of the housing 14. The externally toothed annular gear 54 is adapted to rotate about a first axis 58. Torque for rotating the externally toothed annular gear 54 counterclockwise about the first axis 58 is transferred to the externally toothed annular gear 54 through a drive shaft 62. The drive shaft 62 runs within the first bore 26 of the housing 14. The externally toothed annular gear 54 includes a plurality of teeth 66 around its periphery 70. Each of the plurality of teeth 66 is separated by a corresponding plurality of external troughs 74. Further, each of the external gear teeth 66 includes a tip 78 and a pair of flanks 80*a*, 80*b* on opposite sides of the tip 78.

An internally toothed annular gear 84, also referred to as the driven gear 84, is also supported within the second bore 30 of the housing 14. The internally toothed annular gear 84 is adapted to rotate about a second axis 88. The first axis 58 and the second axis 88 are parallel to each other and offset radially. The internally toothed annular gear 84 includes a plurality of teeth 92 around an inside cylindrical wall 96. Each of the plurality of teeth 92 is separated by a corresponding plurality of internal troughs 100. Further, each of the internal gear teeth 92 includes a tip 104 and a pair of flanks 108*a*, 108*b* on opposite sides of the tip 104.

The external gear teeth 66 of the externally toothed annular gear 54 mesh with the internal gear teeth 92 of the internally toothed annular gear 84 between the inlet port 42 and the discharge port 46. The flanks 80*a* of a plurality of external gear teeth 66 of the driving gear 54 bear against the flanks 108*a* of a corresponding plurality of internal gear teeth 92 on the driven gear 84 to create a plurality of seal points 112. Driving torque is transferred from the driving gear 54 to the driven gear 84 at the seal points 112. The seal points 112 entrap fluid in chambers 116 defined by the driving gear 54 and driven gear 84. In such manner, the discharge port 46 is sealed from the inlet port 42 in the direction of rotation of the driving gear 54 and driven gear 84. However, fluid within the chambers 116 is transferred from the inlet port 42 to the discharge port 46 after the fluid undergoes a full revolution of the driving gear 54 and driven gear 84.

Within the housing 14 is a crescent shaped body 120. The crescent shaped body is preferably steel. The crescent body 120 contains an inner arcuate wall 128 and an outer arcuate wall 132. The crescent body 120 is attached to the end of an actuating cylinder 136. The actuating device may be a variety of types such as air controlled, oil controlled, hydraulic controlled, or stepper motor controlled. The actuating cylinder 136 moves axially within the third bore 34 of the housing 14, resulting in axial movement of the crescent body 120.

In normal operation, as shown by FIG. 2, the actuating cylinder 136 is held in an up position, by a retractor spring, not shown, within the third bore 34. Due to its attachment, the crescent body 120 is similarly in an up position as shown. In this position, the crescent body 120 is located in the third bore 34 above and separate from the driving gear 54, and the driven gear 84, contained in the second bore 30. While in this position, the crescent body 120 does not function as a seal between the driving gear 54 and the driven gear 84, and no substantial pressure or oil flow can be produced. As a result, since no substantial pressure or oil flow can be produced, no meaningful torque is created on the planetary differential system and the drive shaft 62.

As shown in FIG. 1 with the actuating cylinder 136 in a down position, when a situation exists where torque control is desirable, such as the loss of traction on a driving wheel in an automobile, pressurized oil is admitted to the third bore 34 containing the actuating cylinder 136. The pressurized oil forces the actuating cylinder 136 axially downward within the third bore 34 into a down position. Due to its attachment to the actuating cylinder 136, the crescent body 120 is similarly forced axially downward into a down position. In this position, the crescent body 120 is located in the second bore 30 in a chamber 140 defined by the driving gear 54 and the driven gear 84. While in this position, the inner arcuate wall 128 of the crescent body 120 contacts one or more tips 78 of the external teeth 66 of the driving gear 54. Likewise, the outer arcuate wall 132 of the crescent body 120 contacts one or more tips 104 of the internal teeth 92 of the driven gear 84. When torque control is no longer required, pressurized oil is withdrawn from the third bore 34 containing the actuating cylinder 136, and the crescent body 120 proceeds back to an up position. The retractor spring, not shown, holds the crescent body 120 in the up position.

In such manner, the arcuate shape of the crescent body 120 allows one or more tips 78 of the external teeth 66 to form one or more seals 144 with the inner arcuate wall 128, to restrict oil flow within the housing 14. Similarly, the shape of the crescent body 120 allows one or more tips 104 of the internal teeth 92 to form one or more seals 148 with the outer arcuate wall 132, to restrict oil flow within the housing 14. The seals 144, 148 are flow resistant and create pressure within the housing 14 as oil attempts to flow. As a consequence, torque is produced by the planetary gear system. The torque required to drive the crescent oil pump 10 is a function of the pressure created. As a result, the torque may be regulated by regulating the pressure within the system.

In a preferred embodiment, to regulate the torque within the system, sensors are input to a traction control microprocessor. The microprocessor controls a valve. The valve controls the position of the crescent body 120. The position of the crescent body 120 controls pump pressure within the housing 14. The pump pressure, within the housing, controls pump torque. The pump torque controls output torque utilizing a planetary differential.

The system's ability to regulate torque allows for low parasitic loss, due to the crescent body seals restricting oil leakage, while allowing for rapid pressure transient response when increased pressure is necessary. While the system allows peak torque to be delivered, at the same time, fuel efficiency is improved as a result of the pressure and torque controls made possible by the movable crescent body.

Figure 4:
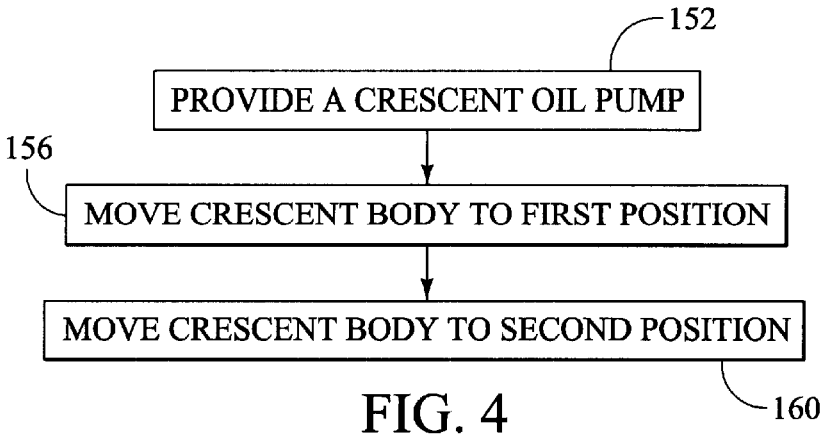
FIG. 4 is a flow diagram illustrating one exemplary method in accordance with the present invention.

As shown in FIG. 4, one exemplary method of controlling oil flow within a crescent oil pump is to first provide a crescent oil pump 152. As described in the embodiment above, the crescent oil pump comprises a housing, an externally toothed annular gear capable of rotation about a first axis, and an internally toothed annular gear capable of rotation about a second axis. The first and second axes are preferably offset. Further, the crescent oil pump comprises an actuating device. The actuating device may be a variety of types such as air controlled, oil controlled, or stepper motor controlled. The crescent body is adapted to move from a first position to a second position utilizing the actuating device. Preferably, the crescent body is attached to an end of the actuating device, and the crescent body moves axially.

Next, the crescent body is moved to the first position using the actuating device to restrict oil flow within the housing 156. In this position, the crescent body forms one or more seals with each of the externally toothed annular gear and the internally toothed annular gear, thereby restricting oil flow. Finally, the crescent body is moved to the second position using the actuating device to permit oil flow within the housing 160. In this position, the crescent body is separate from both the externally toothed annular gear and the internally toothed annular gear, thereby permitting oil flow.

It is to be understood that the invention is not to be limited to the exact construction and/or method which has been illustrated and discussed above, but that various changes and/or modifications may be made without departing from the spirit and the scope of the invention.

What is claimed is:

1. A crescent oil pump comprising:

a housing;

an externally toothed annular gear capable of rotation about a first axis;

an internally toothed annular gear capable of rotation about a second axis; and a crescent body adapted to move from a first position to a second position, wherein when in the first position the crescent body is adapted to form at least one seal between a portion of the externally toothed annular gear and a portion of the internally toothed annular gear, and when in the second position the crescent body is positioned so that it does not form a seal between the portion of the externally toothed annular gear and the portion of the internally toothed annular gear.

2. The invention of claim 1 wherein the crescent body is at least partially removed from between the externally toothed annular gear and the internally toothed annular gear.

3. The invention of claim 1 wherein said first and second axis are offset.

4. The invention of claim 1 wherein said crescent body is steel.

5. The invention of claim 1 wherein when in the first position the crescent body is adapted to restrict oil flow within the housing.

6. The invention of claim 1 wherein when in the second position the crescent body is adapted to permit oil flow within the housing.

7. The invention of claim 1 wherein the crescent body further comprises an inner wall and an outer wall, and wherein when in the first position the external teeth of the externally toothed annular gear are adapted to cooperate with the inner wall to form at least one seal, and the internal teeth of the internally toothed annular gear are adapted to cooperate with the outer wall to form at least one seal.

8. The invention of claim 1 wherein the crescent body further comprises an inner wall and an outer wall, and wherein when in the second position the external teeth of the externally toothed annular gear are adapted to be separate from the inner wall and the internal teeth of the internally toothed annular gear are adapted to be separate from the outer wall.

9. The invention of claim 1 wherein the crescent body is adapted to move axially from the first position to the second position.

10. The invention of claim 1 wherein movement of the crescent body is controlled by an actuating device.

11. The invention of claim 10 wherein the actuating device is one of the group consisting of air controlled, oil controlled, hydraulic controlled, and stepper motor controlled.

12. A crescent oil pump comprising:

a housing;

an externally toothed annular gear capable of rotation about a first axis;

an internally toothed annular gear capable of rotation about a second axis;

an actuating device; and a crescent body comprising an inner wall and an outer wall adapted to move from a first position to a second position by said actuating device, wherein when in the second position, to permit oil flow with the housing, the external teeth of the externally toothed annular gear are adapted to be separate from the inner wall, and the internal teeth of the internally toothed annular gear are adapted to be separate from the outer wall.

13. The invention of claim 12 wherein the actuating device is one of the group consisting of air controlled, oil controlled, hydraulic controlled, and stepper motor controlled.

14. The invention of claim 12 wherein said first and second axis are offset.

15. The invention of claim 12 wherein said crescent body is steel.

16. The invention of claim 12 wherein the crescent body is at an end of an actuating cylinder which moves the crescent body axially.

17. The invention of claim 12 wherein when in the first position the crescent body is adapted to form at least one seal between a portion of the externally toothed annular gear and a portion of the internally toothed annular gear, and when in the second position the crescent body is adapted to unseal the portion of the externally toothed annular gear from the portion of the internally toothed annular gear.

18. The invention of claim 12 wherein the crescent body further comprises an inner wall and an outer wall, and wherein when in the first position, to restrict oil flow within the housing, the external teeth of the externally toothed annular gear are adapted to cooperate with the inner wall to form at least one seal, and the internal teeth of the internally toothed annular gear are adapted to cooperate with the outer wall to form at least one seal.

19. A method of controlling oil flow within a crescent oil pump comprising:

providing a crescent oil pump comprising a housing, an externally toothed annular gear capable of rotation about a first axis, an internally toothed annular gear capable of rotation about a second axis, an actuating device, and a crescent body comprising an inner wall and an outer wall adapted to move from a first position to a second position by said actuating device, wherein when in the second position, to permit oil flow within the housing, the external teeth of the externally toothed annular gear are adapted to be separate from the inner wall, and the internal teeth of the internally toothed annular gear are adapted to be separate from the outer wall;

moving said crescent body to said first position using said actuating device to restrict oil flow within the housing; and moving said crescent body to said second position using said actuating device to permit oil flow within the housing.

20. The invention of claim 19 wherein the crescent body is at an end of an actuating cylinder which moves the crescent body axially.

21. The invention of claim 19 wherein the actuating device is one of the group consisting of air controlled, oil controlled, hydraulic controlled, and stepper motor controlled.

22. The invention of claim 19 wherein when in the first position the crescent body is adapted to form at least one seal between a portion of the externally toothed annular gear and a portion of the internally toothed annular gear, and when in the second position the crescent body is adapted to unseal the portion of the externally toothed annular gear from the portion of the internally toothed annular gear.

23. The invention of claim 19 wherein the crescent body further comprises an inner wall and an outer wall, and wherein when in the first position, to restrict oil flow within the housing, the external teeth of the externally toothed annular gear are adapted to cooperate with the inner wall to form at least one seal, and the internal teeth of the internally toothed annular gear are adapted to cooperate with the outer wall to form at least one seal.

24. A method of controlling oil flow within a crescent oil pump comprising:

providing a crescent oil pump comprising a housing, an externally toothed annular gear capable of rotation about a first axis, an internally toothed annular gear capable of rotation about a second axis, and a crescent body adapted to move from a first position to a second position, wherein when in the first position the crescent body is adapted to form at least one seal between a portion of the externally toothed annular gear and a portion of the internally toothed annular gear, and when in the second position the crescent body is positioned so that it does not form a seal between the portion of the externally toothed annular gear and the portion of the internally toothed annular gear;

moving said crescent body to said first position to restrict oil flow within the housing; and moving said crescent body to said second position to permit oil flow within the housing.

25. The invention of claim 24 further comprising providing an actuating device, wherein said actuating device is used to move said crescent body to said first and second positions.

* * * * *